US007384516B2

(12) United States Patent
Fitzpatrick et al.

(10) Patent No.: US 7,384,516 B2
(45) Date of Patent: Jun. 10, 2008

(54) BELT WITH VARIABLE GROOVES

(75) Inventors: Keith Fitzpatrick, Dieren (NL); Thomas Krauthauf, Ettrinsen (DE)

(73) Assignee: Albany International Corp., Albany, NY (US)

( * ) Notice: Subject to any disclaimer, the term of this patent is extended or adjusted under 35 U.S.C. 154(b) by 400 days.

(21) Appl. No.: 10/978,514

(22) Filed: Nov. 1, 2004

(65) Prior Publication Data

US 2005/0115100 A1 Jun. 2, 2005

Related U.S. Application Data

(60) Provisional application No. 60/516,786, filed on Nov. 3, 2003.

(51) Int. Cl.
*D21F 3/00* (2006.01)

(52) U.S. Cl. ..... 162/358.4; 162/901; 428/163; 428/167

(58) Field of Classification Search ..... 162/205–207, 162/306, 348, 358.3, 358.4, 361, 901; 100/151, 100/153; 428/163, 167, 156, 157; 442/59, 442/148

See application file for complete search history.

(56) References Cited

U.S. PATENT DOCUMENTS

| | | | |
|---|---|---|---|
| 4,427,734 | A | 1/1984 | Johnson |
| 4,482,430 | A | 11/1984 | Majaniemi |
| 4,559,258 | A | 12/1985 | Kiuchi |
| 4,567,077 | A | 1/1986 | Gauthier |
| 4,643,916 | A | 2/1987 | Kiuchi |
| 4,946,731 | A | 8/1990 | Dutt |
| 5,208,087 | A | 5/1993 | Stigberg |
| 5,238,537 | A | 8/1993 | Dutt |
| 5,360,656 | A | 11/1994 | Rexfelt et al. |
| 5,626,723 | A | 5/1997 | Schiel et al. |
| 5,792,323 | A | 8/1998 | Grondahl |
| 5,837,080 | A | 11/1998 | Grondahl |
| 5,914,007 | A | 6/1999 | Henssler et al. |

(Continued)

FOREIGN PATENT DOCUMENTS

| | | |
|---|---|---|
| CA | 2240793 | 12/1998 |

(Continued)

OTHER PUBLICATIONS

DE 44 01 580 English language translation Jun. 1994.*

(Continued)

*Primary Examiner*—Eric Hug
(74) *Attorney, Agent, or Firm*—Frommer Lawrence & Haug LLP; Ronald R. Santucci

(57) ABSTRACT

A belt for use in a papermaking process, such as in a long nip press having a cylindrical press roller and an arcuate pressure shoe which define a nip. The belt has a nip load zone which passes through the nip during an operation. The belt comprises a substrate having a coating on at least one surface thereof. The substrate is in the form of an endless loop and has a longitudinal direction. The coating has a plurality of grooves running in a center portion of the nip load zone, in which the number of grooves have at least one of a depth, width, cross-sectional shape, or spacing which is different from that of the others so as to vary the void volume in a desired manner.

24 Claims, 2 Drawing Sheets

U.S. PATENT DOCUMENTS

| | | | | |
|---|---|---|---|---|
| 6,029,570 | A | 2/2000 | Matuschczyk | |
| 6,030,503 | A * | 2/2000 | Matuschczyk | 162/358.4 |
| 6,428,874 | B1 | 8/2002 | McGahern et al. | |
| 6,854,301 | B1 | 2/2005 | Romanski | |
| 7,097,741 | B2 * | 8/2006 | Watanabe et al. | 162/358.4 |
| 2004/0112561 | A1 | 6/2004 | Watanabe et al. | |
| 2005/0274475 | A1 * | 12/2005 | Hikida | 162/358.3 |

FOREIGN PATENT DOCUMENTS

| | | | |
|---|---|---|---|
| DE | 44 01 580 | * | 6/1994 |
| DE | 44 11 621 | A | 10/1995 |
| DE | 44 45 472 | A | 6/1996 |
| DE | 44 45 572 | * | 6/1996 |
| DE | 197 52 725 | A | 6/1999 |
| DE | 44 45 472 | C2 | 5/2000 |
| EP | 0 886 004 | * | 12/1998 |
| JP | 305334 | | 4/2000 |

OTHER PUBLICATIONS

DE 44 45 472 English language abstract Jun. 1996.*

* cited by examiner

BELT WITH VARIABLE GROOVES

CROSS-REFERENCE TO RELATED APPLICATIONS

This application is based upon and claims the benefit of U.S. Provisional Patent Application Ser. No. 60/516,786 filed Nov. 3, 2003 entitled "BELT WITH VARIABLE GROOVE DEPTH FOR CD MOISTURE IMPROVEMENT", the disclosure of which is incorporated herein by reference.

BACKGROUND OF THE INVENTION

1. Field of the Invention

The present invention relates to a fibrous web being processed into a paper product on a papermaking machine. More specifically, the present invention relates to a method and device for pressing operations associated with the production of paper.

2. Description of the Related Art

During the papermaking process, a fibrous web of cellulosic fibers is formed on a forming wire by depositing a fibrous slurry thereon in the forming section of a paper machine. A large amount of water is drained from the slurry in the forming section, after which the newly formed web is conducted to a press section. The press section includes a series of press nips, in which the fibrous web is subjected to compressive forces applied to remove water therefrom. The web finally is conducted to a drying section which includes heated dryer drums around which the web is directed. The heated dryer drums reduce the water content of the web to a desirable level through evaporation to yield a paper product.

Rising energy costs have made it increasingly desirable to remove as much water as possible from the web prior to its entering the dryer section. As the dryer drums are often heated from within by steam, costs associated with steam production can be substantial, especially when a large amount of water needs to be removed from the web.

Traditionally, press sections have included a series of nips formed by pairs of adjacent cylindrical press rolls. In recent years, the use of long press nips of the shoe type has been found to be more advantageous than the use of nips formed by pairs of adjacent press rolls. This is because the web takes longer to pass through a long press nip than through one formed by press rolls. The longer the time a web can be subjected to pressure in the nip, the more water can be removed there, and, consequently, the less water will remain behind in the web for removal through evaporation in the dryer section.

The present invention relates to long nip presses of the shoe type. In this variety of long nip press, the nip is formed between a cylindrical press roll and an arcuate pressure shoe. The latter has a cylindrically concave surface having a radius of curvature close to that of the cylindrical press roll. When the roll and shoe are brought into close physical proximity to one another, a nip which can be five to ten times longer in the machine direction than one formed between two press rolls is formed. Since the long nip is five to ten times longer than that in a conventional two-roll press, the so-called dwell time of the fibrous web in the long nip is correspondingly longer under the same level of pressure per square inch in pressing force used in a two-roll press. The result of this long nip technology has been a dramatic increase in dewatering of the fibrous web in the long nip when compared to conventional nips on paper machines.

A long nip press of the shoe type requires a special belt, such as that shown in U.S. Pat. No. 5,238,537. This belt is designed to protect the press fabric supporting, carrying and dewatering the fibrous web from the accelerated wear that would result from direct, sliding contact over the stationary pressure shoe. Such a belt must be provided with a smooth, impervious surface that rides, or slides, over the stationary shoe on a lubricating film of oil. The belt moves through the nip at roughly the same speed as the press fabric, thereby subjecting the press fabric to minimal amounts of rubbing against the surface of the belt.

Belts of the variety shown in U.S. Pat. No. 5,238,537 are made by impregnating a woven base fabric, which takes the form of an endless loop, with a synthetic polymeric resin. Preferably, the resin forms a coating of some predetermined thickness on at least the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or fabrics, and fibrous web.

The base fabric of the belt shown in U.S. Pat. No. 5,238,537 may be woven from monofilament yarns in a single- or multi-layer weave, and woven so as to be sufficiently open to allow the impregnating material to totally impregnate the weave. This eliminates the possibility of any voids forming in the final belt. Such voids may allow the lubrication used between the belt and shoe to pass through the belt and contaminate the press fabric or fabrics and fibrous web. The base fabric may be flat-woven, and subsequently seamed into endless form, or woven endless in tubular form.

When the impregnating material is cured to a solid condition, it is primarily bound to the base fabric by a mechanical interlock, wherein the cured impregnating material surrounds the yarns of the base fabric. In addition, there may be some chemical bonding or adhesion between the cured impregnating material and the material of the yarns of the base fabric.

Long nip press belts, such as that shown in U.S. Pat. No. 5,238,537, depending on the size requirements of the long nip presses on which they are installed, have lengths from roughly 13 to 35 feet (approximately 4 to 11 meters), measured longitudinally around their endless-loop forms, and widths from roughly 100 to 450 inches (approximately 250 to 1125 centimeters), measured transversely across those forms. It will be appreciated that the manufacture of such belts is complicated by the requirement that the base fabric be endless prior to its impregnation with a synthetic polymeric resin.

It is often desirable to provide the belt with a resin coating of some predetermined thickness on its outer surface as well as on its inner surface. By coating both sides of the belt, its woven base fabric will be closer to, if not coincident with, the neutral axis of bending of the belt. In such a circumstance, the internal stresses which arise when the belt is flexed on passing around a roll or the like on a paper machine will be less likely to cause the coating to delaminate from either side of the belt.

Moreover, when the outer surface of the belt has a resin coating of some predetermined thickness, it permits grooves, blind-drilled holes or other cavities or voids to be formed on that surface without exposing any part of the woven base fabric. These features provide for the temporary storage of water pressed from the web in the press nip. In fact, for some long nip press configurations the presence of some void volume, provided by grooves, blind-drilled holes or the like, on the outer surface of the belt is a necessity.

Although consistency and drainage properties of the web are attempted to be kept as constant as possible throughout the papermaking process, variability inevitably occurs. Characteristics of the web such as moisture content may change over time. The moisture content of the web may affect the final product's strength and quality. For example, an excessively variable moisture content in the cross direction (CD) profile may lead to variable sheet characteristics, such as curl, and a decrease in product quality. Thus, there is a need to control the CD moisture profile during the papermaking process.

In contrast to the belts of the prior art, the present invention may provide an improved belt with variable void volume to correct (flatten) the CD sheet moisture profile. Specifically, the belt of the present invention may, for example, provide grooves of varying depth in the area of the belt that is subject to compressive forces in the nip. The grooves of varying depth improve the CD moisture profile of the belt, thus enhancing product quality. Alternatively, the present invention may provide grooves having varying or different shapes, dimensions and/or sizes, widths and lengths, in the area of the belt that is subject to compressive forces in the nip. Still further, the present invention may vary the orientation and/or the number of grooves in this area in combination with any of the foregoing variables.

SUMMARY OF THE INVENTION

Accordingly, the present invention is a belt for a papermaking process. Specifically, the belt may be used in a long nip press where the press having a cylindrical press roller and an arcuate pressure shoe which together define a nip therebetween.

The present belt has a nip load zone and two edge zones and is operable such that the nip load zone passes through the nip during an operation. The belt comprises at least one layer having a resin coating on at least one surface thereof, in which the belt is in the form of an endless loop having a longitudinal or machine direction. The resin layer has a plurality of grooves including a number of first grooves and a number of second grooves running in a direction substantially parallel to the longitudinal direction in a center portion of the nip load zone, in which the number of first grooves have at least one of a depth, cross-sectional shape, size, or width or combination thereof which is different from that of the number of second grooves.

The present invention will now be described in more complete detail with frequent reference being made to the drawings identified below.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PREFERRED EMBODIMENT

A preferred embodiment of the present invention will be described in the context of a long nip shoe press belt.

Figure 1:
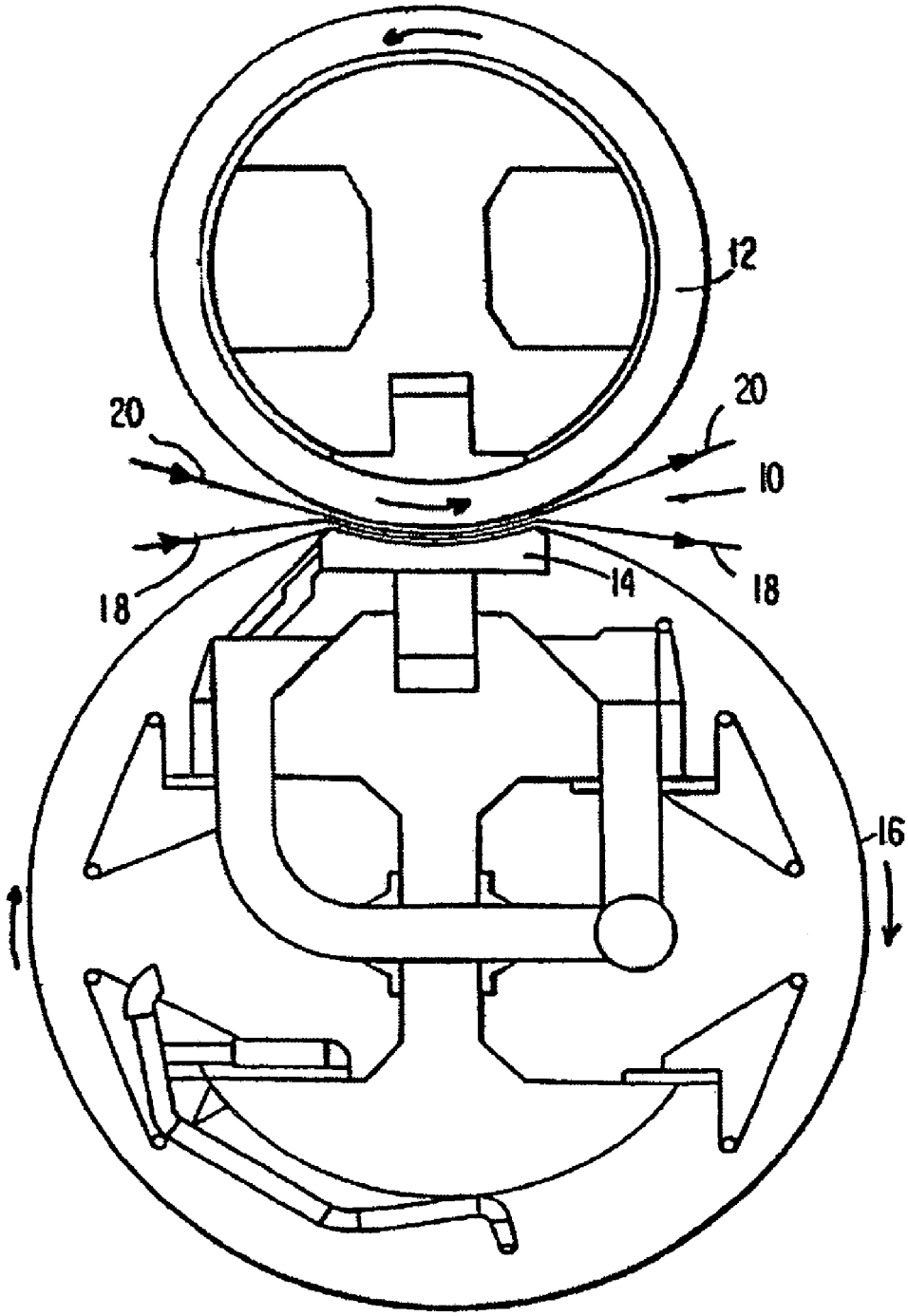
FIG. 1 is a side cross-sectional view of a long nip press.

A long nip press for dewatering a fibrous web being processed into a paper product on a paper machine is shown in a side cross-sectional view in FIG. 1. Press nip 10 is defined by smooth cylindrical press roll 12 and arcuate pressure shoe 14. Arcuate pressure shoe 14 has about the same radius of curvature as cylindrical press roll 12. The distance between cylindrical press roll 12 and arcuate pressure shoe 14 may be adjusted by hydraulic means or the like operatively attached to arcuate pressure shoe 14 to control the loading of nip 10. The smooth cylindrical press roll 12 may be a controlled crown roll matched to the arcuate pressure shoe 14 to obtain a level cross-machine nip pressure profile. Oftentimes a CD sheet moisture profile occurs such as a "smile" or "frown" shape. Mechanical correction of it sometimes is ineffective or not sufficient to one's satisfaction.

Long nip press belt 16 extends in a closed loop through nip 10, separating cylindrical press roll 12 from arcuate pressure shoe 14. The press fabric 18 and the fibrous web 20 being processed into a paper sheet pass together through nip 10 as indicated by the arrows in FIG. 1. Fibrous web 20 is supported by press fabric 18 and comes into direct contact with smooth cylindrical press roll 12 in nip 10. Alternatively, fibrous web 20 may pass through nip 10 sandwiched between two press fabrics 18 (second press fabric not shown). Long nip press belt 16, also moving through press nip 10 as indicated by arrows, that is, clockwise as depicted in FIG. 1, protects press fabric 18 from direct sliding contact against arcuate pressure shoe 14, and typically slides thereover on a lubricating film of oil. Long nip press belt 16, accordingly, is impermeable to oil, so that press fabric 18 and fibrous web 20 will not be contaminated thereby.

Figure 2:
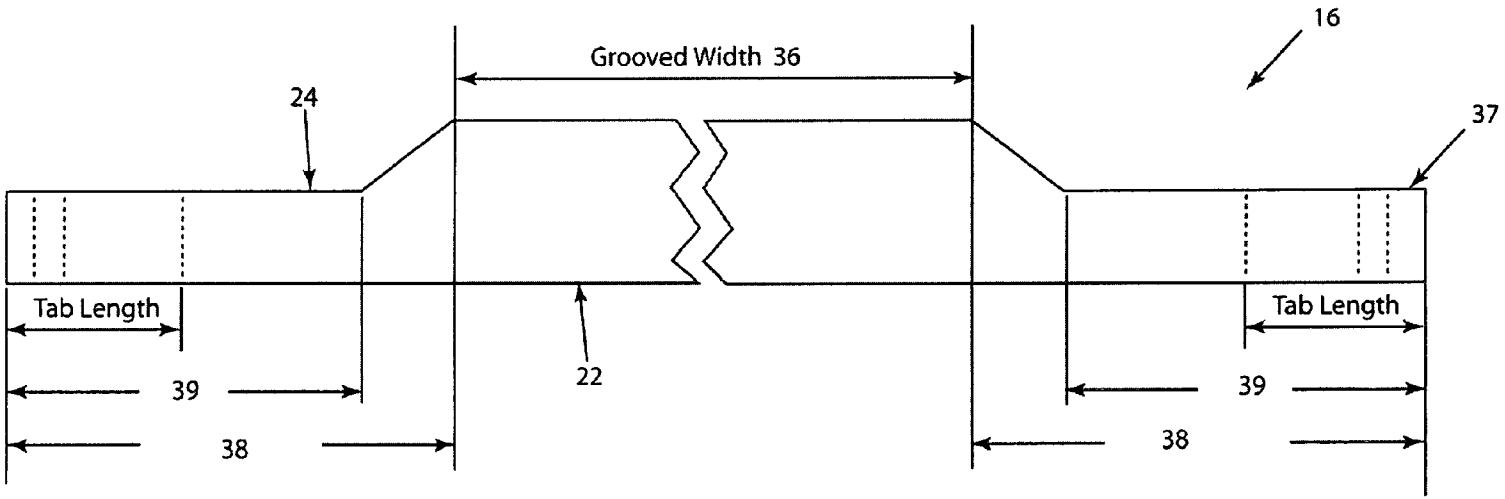
FIG. 2 is a cross-sectional view of a belt in accordance with an embodiment of the present invention.

FIG. 2 is a cross-sectional view of a belt in accordance with an embodiment of the present invention. As shown therein, belt 16 may include nip load zone 36 and edge zones 38. Nip load zone 36 is the area of the belt which may pass between press roll 12 and arcuate pressure shoe 14 and which may be in compression therefrom and is the area of the belt to which this invention is directed. Edge zones 38 define the areas on the belt from belt edges 37 to nip load zone 36 and-take on configurations known to those skilled in the art. Nip load zone 36 may have an edge zone 38 on both sides thereof in a cross-machine direction of the belt. Nip load zone 36 and edge zone 38 extend in the machine running or longitudinal direction of the belt as well.

Figure 3:
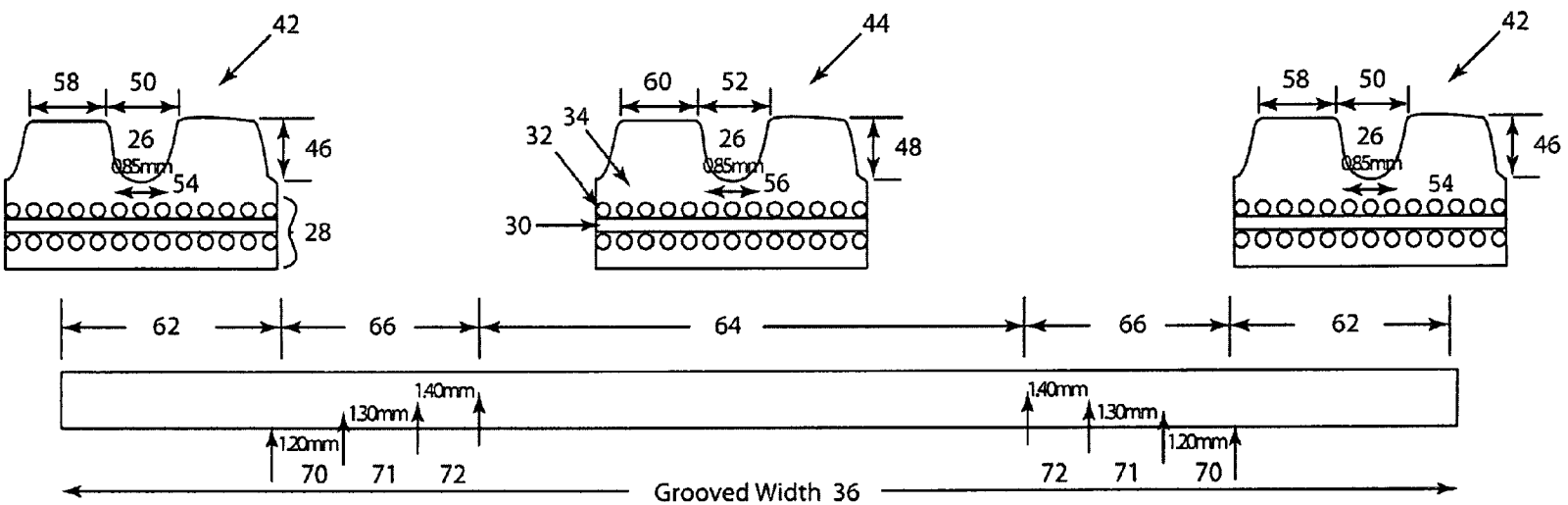
FIG. 3 is an exploded view of the nip load zone of the belt illustrated in FIG. 2.

Belt 16 may include at least one layer, such as a base structure or substrate layer 28 shown in FIG. 3. However, belt 16 may also contain additional layers. Layer 28 may be a nonwoven structure in the form of an assembly of transverse, or cross-machine direction yarns 30 (viewed from the side in FIG. 3), and longitudinal or machine-direction yarns 32, which depending upon the application can be bonded together at their mutual crossing points to form a fabric.

Layer 28 may alternatively be woven. The transverse yarns being warp yarns weaving over, under and between the longitudinal yarns. It should be understood that layer 28 may be flat woven, and subsequently joined into endless form with a seam. It should be further understood that layer 28 may be woven in a single layer weave, or in any other weave pattern which may be known to those skilled in the art.

Further, layer 28 may be a knitted or braided fabric, or a spiral-link belt of the type shown in U.S. Pat. No. 4,567,077 to Gauthier, the teachings of which are incorporated herein by reference. Layer 28 may also be extruded from a polymeric resin material in the form of a sheet or membrane, which may subsequently be provided with apertures. Alternatively still, at least one layer 28 may comprise nonwoven mesh fabrics, such as those shown in commonly assigned U.S. Pat. No. 4,427,734 to Johnson, the teachings of which are incorporated herein by reference.

Further, layer 28 may be produced by spirally winding a strip of woven, nonwoven, knitted, braided, extruded or nonwoven mesh material according to the methods shown in commonly assigned U.S. Pat. No. 5,360,656 to Rexfelt et al., the teachings of which are incorporated herein by reference. Layer 28 may accordingly comprise a spirally wound strip, wherein each spiral turn is joined to the next by a continuous seam making layer 28 endless in a longitudinal direction. A long nip or shoe press belt having a layer of this type is disclosed in commonly assigned U.S. Pat. Nos. 5,792,323 and 5,837,080, the teachings of which are incorporated herein by reference.

A resin such as a polymer resin 34 is deposited, coated, impregnated or otherwise disposed on at least one surface of belt 16. Polymer resin 34 may be coated or otherwise disposed on outer surface 24 of belt 16, that is, the surface which contacts press fabric 18 when belt 16 is in use on a long nip press. In addition, the polymer resin may be coated or otherwise disposed on inner surface 22 of belt 16, that is, the surface which slides over the arcuate pressure shoe 14 when belt 16 is in use on a long nip press. Alternatively, the polymer resin may be coated on both the inner surface 22 and outer surface 24 of belt 16. The polymeric resin may impregnate layer 28, and render belt 16 impermeable to oil, water, and the like. Polymeric resin coating 34 may be of polyurethane, and may be a 100% solids composition thereof. The use of a 100% solids resin system, which by definition lacks a solvent material, avoids the formation of bubbles in the polymeric resin during the curing process through which it proceeds following its application onto layer 28. Other coating material may also be used, for example, rubber or rubber like compounds. In any event, the resin layers can be the same or different, with the same or different hardness level.

Inner surface 22 and/or outer surface 24 may also be ground and buffed after the polymeric resin has been cured to provide the polymeric resin coating with a smooth, uniform surface.

After the polymeric resin has been cured, grooves 26 may be provided into outer surface 24 of belt 16. Specifically, grooves 26 of varying depth may be cut, drilled or otherwise provided in nip load zone 36 (i.e., the area of the belt that undergoes compression, which is usually a portion of the total belt width) and oriented so as to run in the longitudinal direction. In one embodiment of the present invention the grooves 26 run parallel to each other, however, other orientations are considered within the scope of the present invention. Alternatively to cutting, drilling, etc., grooves 26 may be pressed into outer surface 24 by a pressing-type device before the polymeric resin has been cured, or may be molded into outer surface 24 (such as when belt 16 is manufactured using a molding process). As is to be appreciated, other possible ways to form grooves 26 would readily be apparent to one skilled in the art. Note that while the term "grooves" is referred to, what is actually occurring is the creation of voids or void volume in the belt so as to receive the entrained liquid. Variation of such void volume in the belt can be achieved by varying the shapes, dimensions, spacing and orientation of the "grooves" or any combination thereof.

FIG. 3 is an exploded view of nip load zone 36 depicted in FIG. 2. FIG. 3 also shows an exploded view of first groove 42 and second groove 44 on outer surface 24. Note further that all numerical dimensions are used only for illustrative purposes and should by no means be considered exclusive.

First groove 42 and second groove 44 have first depth 46 and second depth 48, respectively. In addition, first groove 42 and second groove 44 have first outside width 50 and second outside width 52, and first inside width 54 and second inside width 56, respectively. Further, first groove 42 and second groove 44 may be continuous or discontinuous in the longitudinal direction. Also, first groove 42 and second groove 44 may be separated between adjacent grooves by so-called first land area 58 and second land area 60. First land area 58 and second land area 60 may be considered narrow pillars of cured polymeric resin running in the machine direction on the outer surface 24 of belt 16. First and second groove depths 46, 48 may have values of about 1.10 mm and 1.5 mm, first inside and outside widths 54, 50 may have values of about 0.85 mm and 1.18 mm, and second inside and outside widths 56, 52 may have values of about 0.85 mm and 1.35 mm, respectively. First land area 58 and second land area 60 may have widths of about 2 mm and 1.88 mm, respectively. As is to be appreciated, other shapes, dimensions, spacing, and orientation of first and/or second grooves 42, 44 and first and/or second land areas 58, 60 may be utilized and are considered to be within the scope of the present invention.

As shown in FIG. 3, nip load zone 36 may include a center portion 64, intermediate portions 66, and outer portions 62. The grooves 26 of the center portion 64, the intermediate portions 66, and the outer portions 62 may have different sizes, orientations, shapes and/or depths or combinations thereof. For example, the center portion 64 may include grooves of a single width and depth; alternatively it may include a number of first grooves 42 and a number of second grooves 44. The grooves within the center portion 64 may be arranged in any manner. That is, the arrangement of such grooves could be a first groove 42 followed by a second groove 44 followed by a first groove 42 and so forth, or a number of first grooves followed by a number of second grooves followed by a number of first grooves and so forth. Further, the center portion 64 may include grooves having more than two different sizes, orientations, shapes and/or depths which could be arranged in any combination. Additionally, one or both of the intermediate portions 66 and outer portions 62 may also include grooves having different sizes, shapes and/or depths and which may be arranged in any manner such as those previously described. Still further, an outer portion 62 or intermediate portion 66 may have a differing shape of groove from one side of the nip load zone 36 to the other.

For example, the intermediate portions 66 may include a step-wise graduation of groove depth. As shown in FIG. 3, intermediate portion 66 includes grooves having an initial depth of about 1.4 mm at location 72, a depth of about 1.3 mm at location 71, and a depth of 1.2 mm at location 70 changing in 0.10 mm increments every 460 mm. Such an arrangement may be particularly useful in embodiments where the center portion 64 has grooves of a depth of about 1.5 mm, and an outer portion with grooves of a depth of 1.1 mm. This essentially results in an increase in the void volume in the center portion 64 which decreases as one goes to the outer portions 62. In short the groove arrangements and characteristics may be optimized to flatten or improve the existing CD moisture profile typically in transitioning from a shorter depth in the outer portions to greater depths in the center portion 64. Note that there may even be included areas of no grooves or a zero depth depending upon the moisture profile being adjusted for.

Although the grooves have been described as having a cross-sectional shape such as that shown in FIG. 3 and as being provided by cutting or forming, the present invention is not so limited. For example, the grooves may have other cross-sectional shapes and may be obtained by other means. As an example, grooves 26 may be provided by a cutting device (such as a drill-type device) which cuts or forms grooves in a spiral or orientation around the circumference of the belt in either a clockwise or counter-clockwise direction which proceed in a substantially longitudinal direction. In such a situation, grooves may be arranged in any combination. In one arrangement, one groove has a clockwise spiral cross-section followed by a groove having a counter-clockwise cross-section followed by a groove having a clockwise spiral cross-section and so forth. Further, each of the grooves 26 may not be perfectly parallel to the longitudinal direction, but may vary therefrom. Additionally, a number of grooves 26 may be oriented so as to run in a direction which forms an angle (such as up to 45 degrees) to a line parallel to the longitudinal direction.

In essence, the principle involves changing the void volume of the grooves in these zones (two edges and the center) such that, for example, the zone with lower available void volume will be able to accept less water. For example, in a typical "frown" CD sheet moisture profile, the sheet edges are drier than the center of the sheet. By reducing the void volume of the two edge areas of the belt, less water will be removed from the sheet in these areas, so the sheet moisture profile exiting the press nip will be flatter. Likewise, for a typical "smile" CD sheet moisture profile the void volume would be reversed.

Modifications to the above would be obvious to those of ordinary skill in the art, but would not bring the invention so modified beyond the scope of the appended claims.

What is claimed is:

1. An endless belt for use in a shoe press having a cylindrical press roll and an arcuate pressure shoe which together define a nip therebetween, said belt including a nip load zone having a width in a cross-machine direction, said belt being operable such that during operation, said belt with said nip load zone passes through said nip, said belt comprising:

a substrate;

at least one coated layer on at least one side of said substrate;

a desired pattern in said layer including grooves; and said desired pattern being such that said nip load zone has a void volume across the width of the nip load zone with said void volume being the result of grooves having a different width, cross sectional shape, spacing, or a combination of one or more of these features together or in conjunction with a different depth so as to vary said void volume and thereby correct the cross-machine direction sheet profile.

2. The belt according to claim 1, wherein said nip load zone includes two outer portions each located on a side of a center portion.

3. The belt according to claim 2, wherein said nip load zone includes two intermediate portions each located on a side of said center portion and between said center portion and said outer portions.

4. The belt according to claim 3, wherein said coated layer has a plurality of grooves in at least one of said two outer portions.

5. The belt according to claim 3, wherein said coated layer has a plurality of grooves in at least one of said intermediate portions.

6. The belt according to claim 2, wherein said coated layer has a plurality of grooves in said outer portion.

7. The belt according to claim 1, wherein said substrate is one selected from the group consisting of woven fabrics, nonwoven fabrics, knitted fabrics, braided fabrics, extruded sheets of polymeric material and nonwoven mesh fabrics, and a spiral-link belt.

8. The belt according to claim 1, wherein said substrate is a strip of material spirally wound in a plurality of turns, each turn being joined to those adjacent thereto by a continuous seam, said strip material being selected from the group consisting of woven fabrics, nonwoven fabrics, knitted fabrics, braided fabrics, extruded sheets of polymeric material, nonwoven mesh fabrics, and a spiral link belt.

9. The belt according to claim 1, wherein said coated layer is a polymeric resin, rubber or rubber like compound.

10. The belt according to claim 2, in which the grooves have a depth which is greatest in the center portion.

11. The belt according to claim 3, wherein the depth of said grooves decreases in a step function from the center portion through the intermediate portion and outer portion.

12. The belt according to claim 11 wherein the intermediate portion includes grooves of two or more depths.

13. The belt according to claim 1 wherein said desired pattern includes portions or a portion which has no grooves.

14. The belt according to claim 1, wherein said grooves are formed in a repeating pattern of differing widths and depths, wherein a first groove having a first width and a first depth can be next to a second groove having a second width and a second depth, which can be next to said first groove having said first width and said first depth, and so forth.

15. The belt according to claim 2, wherein said grooves formed in said center portion have a greater width than grooves formed on said outer portion.

16. The belt according to claim 14, wherein the repeating pattern can comprise more than a first and second groove.

17. The belt according to claim 14, wherein the repeating pattern can comprise multiple first grooves next to multiple second grooves, and so forth.

18. A method of adjusting the moisture profile of a shoe press belt comprising the steps of:

providing a substrate having a coated layer on at least one surface thereof; forming a desired pattern in said layer including grooves; and creating said desired pattern such that said nip load zone has a void volume across the width of the nip load zone which is the result of grooves having a different width, cross sectional shape, spacing, or a combination of one or more of these features together or in conjunction with a different depth, so as to vary said void volume and thereby correct the cross-machine direction sheet moisture profile.

19. The method of claim 18, wherein grooves are formed in a center portion of said nip load zone which have a greater depth than grooves formed on an outer portion of the nip load zone.

20. The method of claim 18, wherein said substrate is one selected from the group consisting of woven fabrics, nonwoven fabrics, knitted fabrics, braided fabrics, extruded sheets of polymeric material and nonwoven mesh fabrics, and a spiral-link belt.

21. The method of claim 18, wherein said substrate is a strip of material spirally wound in a plurality of turns, each turn being joined to those adjacent thereto by a continuous seam, said strip material being selected from the group consisting of woven fabrics, nonwoven fabrics, knitted fabrics, braided fabrics, extruded sheets of polymeric material, nonwoven mesh fabrics, and a spiral link belt.

22. The method of claim 18, wherein said coated layer is a polymeric resin, rubber or a rubber like compound.

23. The method of claim 18, wherein at least a part of said desired pattern has no grooves.

24. An endless belt for use in a shoe press having a cylindrical press roll and an arcuate pressure shoe which together define a nip therebetween, said belt including a nip load zone having a width in a cross-machine direction, said belt being operable such that during operation, said belt with said nip load zone passes through said nip, said belt comprising:

a substrate;

at least one coated layer on at least one side of said substrate;

a desired pattern in said layer including grooves; and said desired pattern being such that said nip load zone has a void volume across the width of the nip load zone with said void volume being the result of grooves having a different width, cross sectional shape, spacing, or a combination of one or more of these features together or in conjunction with a different depth so as to vary said void volume such that a void volume in a center portion of the nip load zone is greater than a void volume in an outer portion of the nip load zone, wherein said width, cross-sectional shape, spacing, or a combination of one or more of these features or together in conjunction with the depth are varied to adjust the void volume to thereby correct the cross-machine direction sheet moisture profile.

* * * * *